US005662749A

United States Patent [19]

Chang

[11] Patent Number: 5,662,749

[45] Date of Patent: Sep. 2, 1997

[54] SUPERSOLVUS PROCESSING FOR TANTALUM-CONTAINING NICKEL BASE SUPERALLOYS

[75] Inventor: Keh-Minn Chang, Morgantown, W. Va.

[73] Assignee: General Electric Company, Schenectady, N.Y.

[21] Appl. No.: 487,223

[22] Filed: Jun. 7, 1995

[51] Int. Cl.[6] ..... C22F 1/10

[52] U.S. Cl. ..... 148/514; 148/677; 148/556; 419/29; 419/42

[58] Field of Search ..... 148/556, 676, 148/677, 514; 419/23, 28, 29, 66

[56] References Cited

U.S. PATENT DOCUMENTS

| | | | |
|---|---|---|---|
| 4,685,977 | 8/1987 | Chang | 148/410 |
| 4,957,567 | 9/1990 | Krueger et al. . | |
| 5,120,373 | 6/1992 | Miller et al. | 148/676 |
| 5,131,961 | 7/1992 | Sato et al. | 148/677 |
| 5,143,563 | 9/1992 | Krueger et al. | 148/410 |
| 5,393,483 | 2/1995 | Chang | 148/677 |
| 5,593,519 | 1/1997 | Blankenship et al. | 148/514 |

*Primary Examiner*—David A. Simmons
*Assistant Examiner*—Margeny S. Phipps
*Attorney, Agent, or Firm*—James Magee, Jr.

[57] ABSTRACT

A tantalum-containing nickel base superalloy having a γ' phase has greatly improved maximum tensile strength which is substantially independent of the frequency of the stress is processed by forging above the γ' solvus temperature and annealing above the recrystallization temperature of the alloy.

1 Claim, 2 Drawing Sheets

SUPERSOLVUS PROCESSING FOR TANTALUM-CONTAINING NICKEL BASE SUPERALLOYS

This invention is directed to nickel base superalloys and in particular to such alloys which contain tantalum and a γ' strengthening phase.

BACKGROUND OF THE INVENTION

Despite fabrication problems, γ' strengthened nickel base superalloys are extensively employed in high performance environment articles. In general, the problems with such alloys relate to the high solvus temperature of the γ' phase. This temperature usually has a value very close to the incipient melting point of the alloy.

Direct hot isostatic pressing of superalloy powder has been used to produce large components in a near-net shape in order to reduce material use and machining waste. However, current processing routes include blank die compaction followed by extrusion and forging.

Considerable effort has been expended in developing alloys and techniques for use in powder metallurgy and processing. Superalloy compositions providing improved resistance to fatigue crack growth at elevated temperatures are particularly useful in making shaped articles by various powder processes.

Crack propagation rate in high strength superalloy bodies depends on applied stress and crack length. These factors combine to provide a crack growth driving force referred to as stress intensity which is proportional to the applied stress multiplied by the square root of crack length $K \approx \sigma\sqrt{\alpha}$.

The most undesirable time-dependent crack growth behavior occurs when a hold-time is imposed at peak stress during the cycle, i.e., when the maximum tensile stress is held constant for a period of time.

Various nickel base alloy compositions are representative of alloying situations in which many of the same elements are combined to achieve distinctly different functional relationships between the elements which provide the alloy system with different physical and mechanical characteristics. However, it is still not possible for workers in the art to predict with any degree of accuracy the physical and mechanical properties that will be displayed by certain concentrations of commonly known elements used in varying combinations to form such alloys even though such combinations may fall within broader more generalized teachings disclosed in the art. This inability to predict is particularly noticeable.

Certain objectives for forgeable nickel base superalloys are known. In the first place, it is important to minimize the time dependence of fatigue crack resistance and to secure values of strength at room and elevated temperature and creep properties that are reasonably comparable to those of known powder processed alloys. It is also important to reduce processing difficulties encountered in previous metal working procedures.

DESCRIPTION OF THE INVENTION

This invention is directed to γ' strengthened nickel base superalloy compositions which can be forged and heat treated to exhibit essentially time independent fatigue crack resistance in combination with high tensile and rupture strength properties. Articles can be manufactured from these alloys using conventional cast and wrought technology, but powder processing techniques are preferred.

The alloys of this invention consist essentially of nickel, chromium, cobalt, molybdenum, tungsten, aluminum, titanium, zirconium, tantalum and boron. The γ' precipitate phase is present in an amount ranging from about 40 to about 60 percent by volume. These alloys are free of the gamma double prime phase. The forged alloy has a grain structure that is predominantly equiaxed with the grain size being about ASTM 5–8 and exhibits fatigue crack growth rates that are substantially independent of the frequency of fatigue stress intensity with or without intermittent periods during which maximum tensile stress is held. This fatigue cracking resistance is demonstrated at temperatures in excess of 648° F.

The compositional range, in weight percent, of the alloys included within the scope of this invention is set out in Table 1 below.

TABLE 1

| | |
|---|---|
| cobalt | 14–22 |
| chromium | 10–14 |
| molybdenum | 2–6 |
| aluminum | 3–5 |
| titanium | 3–5 |
| tantalum | 0.5–6 |
| zirconium | 0–.6 |
| boron | 0.01–0.1 |
| carbon | 0.03–0.1 |
| nickel | balance |

The alloy compositions are selected so as developed from about 40 to about 60 volume percent of the γ' precipitate phase. This volume fraction of the γ' precipitate has been found to provide the required degree of forgeability in the ingot.

Standard superalloy melting procedures can be used to prepare the alloy in powder form.

Vacuum induction melting, vacuum arc remelting or electroslag refining or remelting can be used to prepare ingots of the alloy compositions which are converted to powder by conventional atomization techniques followed by compaction and formation of the near net shape article.

Subsequent mechanical and thermal manufacturing processing will depend upon obtaining accurate information on the phase transition temperature of the alloy composition. Several different methods are available for determining the phase transition temperature of the superalloy. Differential thermal analysis is one such method. A second method requires metallographic examination of the series of samples which are cold rolled to about 30% reduction and then heat treated at various temperatures around the expected phase transition temperature. Each of these methods is carried out on samples of the alloy. The γ' precipitate solvus of an alloy composition of this invention is frequently in the range of from about 1050° to about 1175° C.

BRIEF DESCRIPTION OF THE DRAWINGS

FIGS. 1*a* and 1*b* illustrate that the crack growth resistance advantage for the alloys in this invention over niobium containing alloys and other selected alloys. At 648° C. most alloys do not exhibit time dependent crack growth. However, at 1400° F. many alloys exhibit faster crack growth with longer tensile hold times. The 760° C. crack growth rates for the alloys of this invention do not depend strongly on the hold time. Thus, the crack growth resistance of this class of alloys is superior to that of prior art alloys and other alloys with similar compositions containing niobium.

Figure 1A:
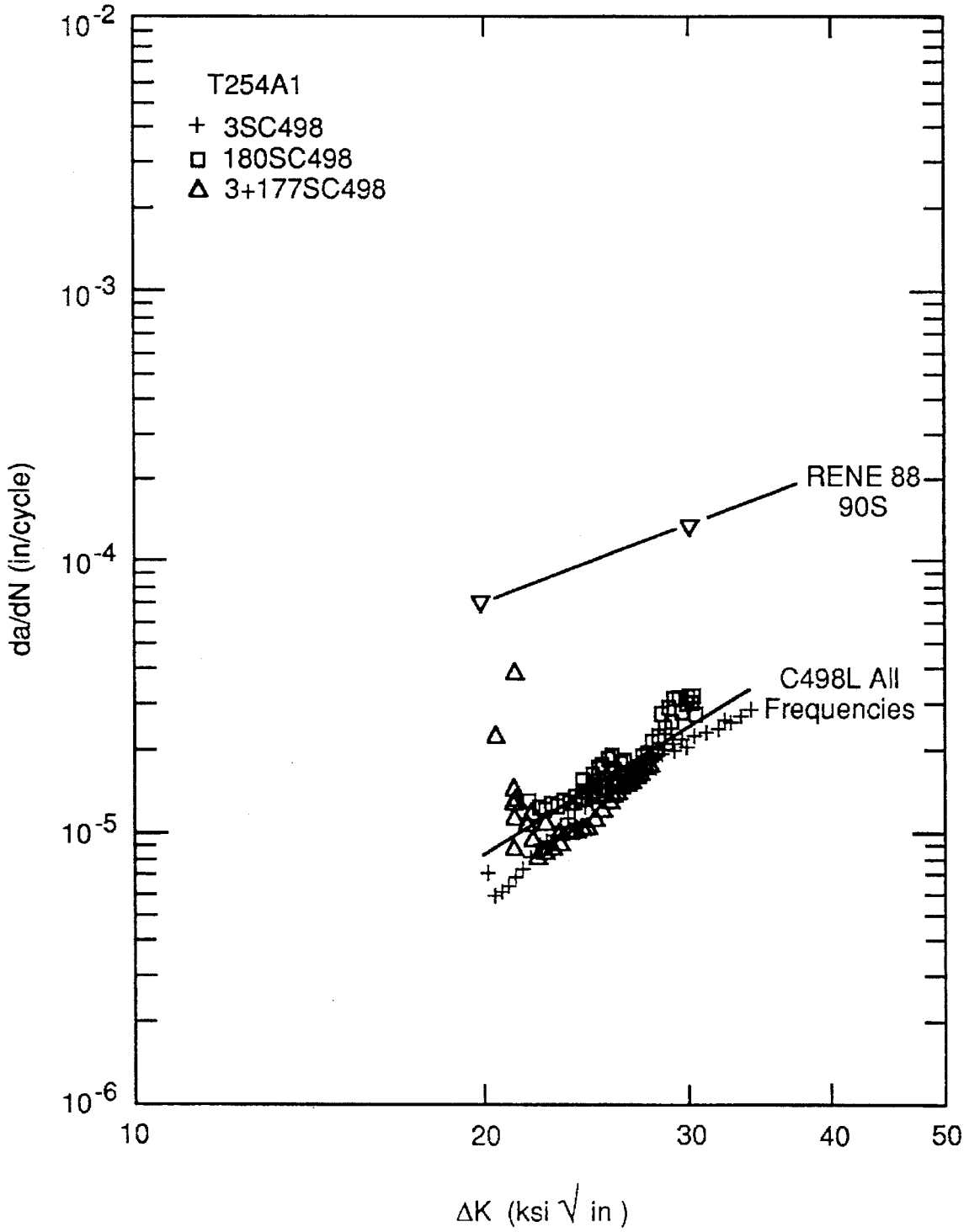
FIG. 1*a* is a graphic representation of fatigue crack growth resistance for the alloys shown in Table 1 at 648° C.
Figure 1B:
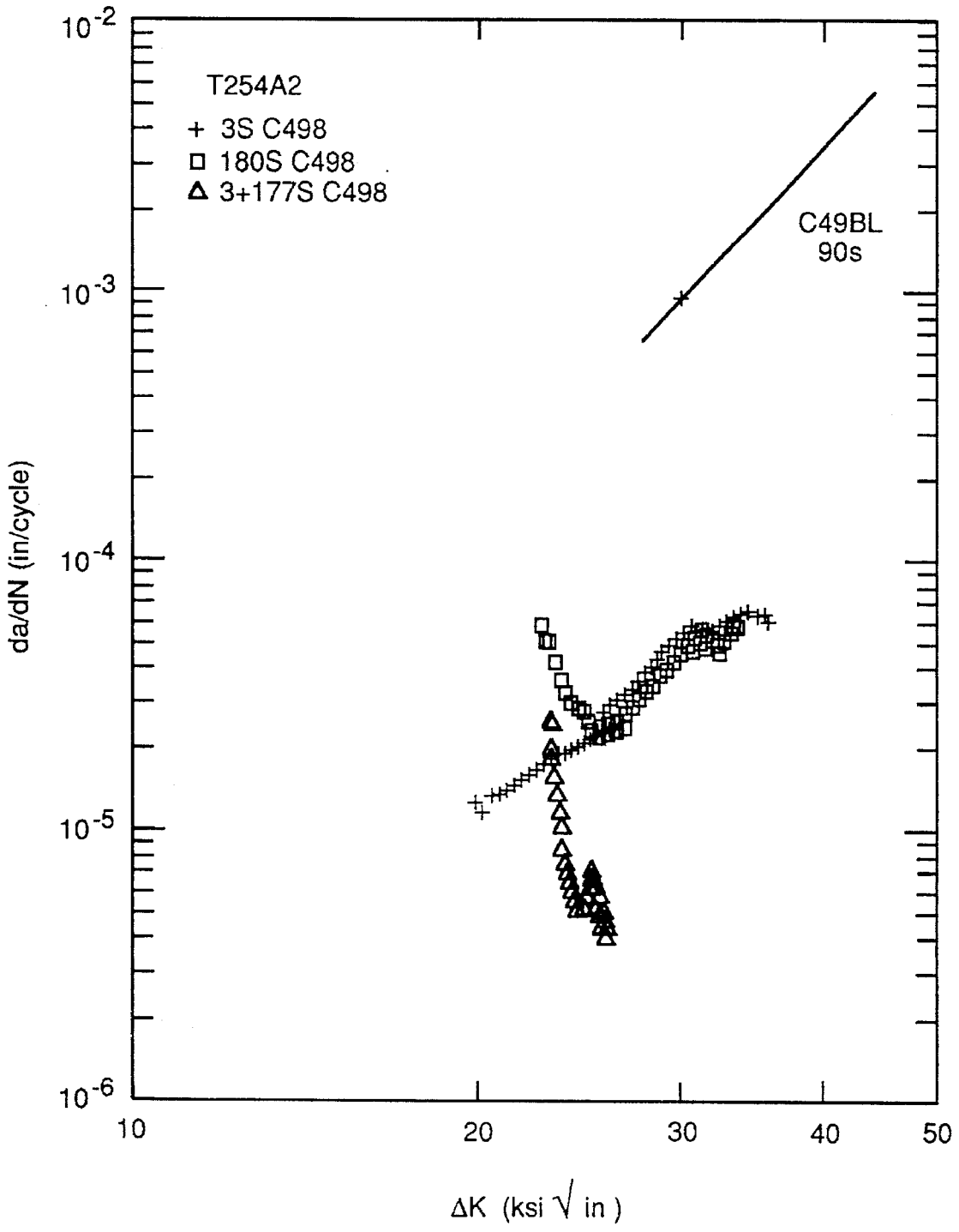
FIG. 1*b* is a graphic representation of fatigue crack growth resistance for the same alloys obtained at 760° C.

Ingots of the following composition were prepared by a vacuum induction melting and casting procedure:

| | |
|---|---|
| 17.7–18.0 | cobalt |
| 11.8–12 | chromium |
| 3.9–4.0 | molybdenum |
| 3.9–4.0 | aluminum |
| 3.9–4.0 | titanium |
| 3.8–4.0 | tantalum |
| 0.17–0.3 | zirconium |
| about 0.03 | carbon |
| 0.1–0.6 | boron |
| balance | essentially nickel |

A powder was prepared by melting ingots of the selected composition in an argon gas atmosphere and atomizing the liquid metal using argon gas for atomization. The powder was sieved to remove particles coarser than 150 mesh.

The −150 mesh powder was transferred to consolidation cans for initial densification using a closed die compaction procedure at a temperature of about 66° C. below the γ' solvus. This was followed by extrusion using a 7:1 extrusion reduction ratio at a temperature approximately 37° C. below the γ' solvus to produce a fully dense extrusion.

The extrusions were then solution treated or annealed at a temperature above the γ' solvus temperature in the range of about 1171° C. to about 1182° C. for about 1 hour. This solvus solution treatment completely dissolves the γ' phase and forms a well annealed structure. The solution treatment also recrystallizes and coarsens the fine grain billet structure and permits controlled reprecipitation of the γ' during subsequent heat treatment and processing.

The solution treated extrusions were then rapidly cooled for the solution treatment temperature using a controlled quench. This quench is performed at a rate sufficient to develop a uniform distribution of γ' throughout the article. A controlled fan helium quench having a cooling rate of about 121° C. per minute was used. Following quenching, the alloy was aged at a temperature of about 816° C. to 843° C. for about 4 hours. A preferred temperature range for this aging treatment is about 824° C. to about 835° C. Aging promotes uniform distribution of additional γ' and is particularly suited for an alloy designed for operating service at temperatures of about 816° C.

In order to achieve properties and microstructures which are necessary for the alloys of the present invention, the processing of the superalloy is important. Although a metal powder was produced which was subsequently processed using compaction and extrusion methods followed by a heat treatment it should be understood by those skilled in the art that other methods and associated heat treatments which produce the specific composition, grain size, and microstructure can be used to provide the benefits of this invention.

Solution treating can be carried out at any temperature above which the γ' phase dissolves in the gamma matrix and below the incipient melting temperature of the alloy. The particular temperature at which γ' first begins to dissolve in the matrix is referred to as the γ' solvus temperature. The temperature range between the γ' solvus temperature and the incipient melting temperature is generally referred to as the supersolvus temperature range. This temperature range will vary depending upon the composition of the superalloy. The alloys of this invention were solution treated in the range of about 1175° C. to 1200° C. for about 1 hour. This solution treatment was followed by an aging treatment at a temperature of about 700° C. to about 800° C. for about 4–12 hours.

What is claimed is:

1. A method for making a forged nickel base superalloy body having fatigue crack growth rates at elevated temperatures essentially independent of frequency of cyclical stress applied thereto comprising the sequence of steps of:

a. making a casting of a nickel base superalloy having a composition consisting of about

| | |
|---|---|
| 14–22 | cobalt |
| 10–14 | chromium |
| 2–6 | molybdenum |
| 3–5 | aluminum |
| 3–5 | titanium |
| 0.5–6 | tantalum |
| 0–0.6 | zirconium |
| 0.01–0.1 | boron |
| 0.03–0.1 | carbon |
| balance | nickel, |

b. forming a shaped body by forging said casting at a temperature about 5° C. to about 25° C. above the solvus of the γ' precipitate phase, c. solution annealing the shaped body at a temperature about 5° C. to about 25° C. above the recrystallization temperature of the alloy in the range of about 1175° C. to about 1200° C., d. cooling the shaped body, and e. aging the shaped body.

* * * * *